US006401923B1

(12) United States Patent
Huang

(10) Patent No.: US 6,401,923 B1
(45) Date of Patent: Jun. 11, 2002

(54) TOOL PACKAGING AND DISPLAYING DEVICE

(75) Inventor: Steve Huang, Taichung Hsien (TW)

(73) Assignee: Stanley Chiro International Ltd., Taichung Hsien (TW)

( * ) Notice: Subject to any disclaimer, the term of this patent is extended or adjusted under 35 U.S.C. 154(b) by 0 days.

(21) Appl. No.: 09/986,999

(22) Filed: Nov. 13, 2001

(51) Int. Cl.[7] ..... B65D 85/28
(52) U.S. Cl. ..... 206/376; 206/480
(58) Field of Search ..... 206/376, 480, 206/372, 373, 486, 482

(56) References Cited

U.S. PATENT DOCUMENTS 4,705,168 A * 11/1987 Ward ..... 206/376
4,911,297 A * 3/1990 Suburu ..... 206/372
5,388,694 A * 2/1995 Arendt ..... 206/373
5,505,316 A * 4/1996 Lee ..... 206/376
5,918,741 A * 7/1999 Vasudeva ..... 206/234
5,931,299 A * 8/1999 Hsieh ..... 206/376
5,941,386 A * 8/1999 Hu et al. ..... 206/376

* cited by examiner

*Primary Examiner*—Joseph M. Moy
(74) *Attorney, Agent, or Firm*—Finnegan, Henderson, Farabow, Garrett & Dunner, L.L.P.

(57) ABSTRACT

A tool packaging and displaying device includes a mounting body with front and rear walls, and left and right mounting walls respectively formed with multiple cavities. Posts extend uprightly from each of the mounting walls, and a shoulder is formed between a respective one of the posts and a respective one of the cavities. Each of the posts is connected integrally to a transverse cantilever which is in turn connected integrally to a tongue that extends downwardly toward the respective cavity and that abuts against the shoulder when a grip portion of a hand tool is inserted into the respective cavity. A cover member has one end hingedly connected to the rear wall and a front end with a latch tongue firmly retained in a retaining slot in the front wall by virtue of a locking insert.

13 Claims, 8 Drawing Sheets

TOOL PACKAGING AND DISPLAYING DEVICE

BACKGROUND OF THE INVENTION

1. Field of the Invention

The invention relates to a tool packaging and displaying device, more particularly to a tool packaging and displaying device that can firmly hold a plurality of hand tools, such as spanners, thereon, and that can provide greater security against theft of the hand tools displayed thereon.

2. Description of the Related Art

Referring to FIGS. 1 and 2, a conventional tool displaying device 10 is shown to include a displaying body 11 confining a receiving chamber 12. A suspension handle 13 extends integrally from a front end of the displaying body 11. The displaying body 11 has two side walls 14, each of which has a row of clamping/units 15 disposed thereon. Each clamping unit 15 includes a retaining groove 151 and a resilient plate 152. The resilient plates 152 of two adjacent ones of the clamping units 15 confine an insert slot 153 therebetween such that a spanner 100 can be inserted via the insert slot 153 into the receiving groove 151. The resilient plate 152 extends upwardly and integrally from the respective one of the side walls 14, and has a distal end that is bent to form a cantilever portion 154 such that, during the course of insertion of the spanner 10 into the receiving groove 151, the cantilever portion 154 will be pressed toward the resilient plate 152 against the biasing action thereof so that the spanner 100 can be firmly clamped in the receiving groove 151.

While the displaying device 10 can clamp the spanner 100 firmly thereon, it is not ideal in terms of positioning and security. This is because the cantilever portion 154 can still move in the receiving groove 151 after insertion of the spanner 100 in the receiving groove 151, and the spanner 100 can easily slip from the receiving groove 151 during delivery of the displaying device 10 or upon application of an external force to the spanner 100. Furthermore, when the spanner 100 is displayed on the displaying device 10 in a sales outlet, the spanner 100 can be easily removed from the displaying device 10 by a thief since it is merely disposed in the receiving groove 151. In view of this, manufacturers have developed a kind of tool packaging and displaying box that is provided with a cover hingedly connected to a box body for positioning spanners when in a closed state. As the cover can be easily opened, the spanners are also vulnerable to thieves. There is another kind of tool packaging and displaying box in which a cover is locked to a box body and can be opened only when a locking member is destroyed. However, once opened, the cover can no longer be closed properly.

SUMMARY OF THE INVENTION

Therefore, the main object of the present invention is to provide a tool packaging and displaying device for firmly holding a plurality of hand tools.

Another object of the present invention is to provide a tool packaging and displaying device to provide better security against theft of hand tools displayed thereon.

Accordingly, a tool packaging and displaying device of the present invention is adapted for holding a plurality of hand tools, each having an elongated grip portion extending in a lengthwise direction, first and second clamped surfaces opposite to each other, and a seated wall surface that joins the first and second clamped surfaces. The tool packaging and displaying device includes:

a bottom wall having outer and inner surfaces opposite to each other in a first transverse direction, the outer surface having left and right edges extending in a longitudinal direction and opposite to each other in a second transverse direction transverse to both the first transverse direction and the longitudinal direction;

left and right mounting wall portions extending respectively from the left and right edges in the first transverse direction and outwardly, and terminating respectively at left and right mounting surfaces which face outwardly, which are spaced apart from each other in the second transverse direction, and which cooperate with the bottom wall to confine a receiving space thereamong, each of the left and right mounting surfaces including a plurality of cavities displaced from one another in the longitudinal direction, each of the cavities extending inwardly and in the second direction to form a seat wall adapted to receive the seated wall surface of a respective one of the hand tools, and a proximate wall which forms an angle with the seat wall and which cooperates with a respective one of the left and right mounting surfaces to form a shoulder portion that borders on the respective one of the left and right mounting surfaces at a junction;

left and right sets of posts, each of the posts extending from the junction outwardly and in the first transverse direction to terminate at an outer end, and having a clamping surface and a non-abutting surface which is disposed opposite to the clamping surface in the longitudinal direction and proximate to the shoulder portion;

left and right sets of cantilevers, each of the cantilevers extending from the outer end of a respective one of the posts in the longitudinal direction and away from the clamping surface of the respective one of the posts to terminate at an end edge;

left and right sets of tongues, each of the tongues being disposed to extend inwardly from the end edge of a respective one of the cantilevers and being spaced apart from the non-abutting surface of a respective one of the posts in the longitudinal direction so as to be able to generate a biasing action, each of the tongues confronting and cooperating with the clamping surface of an adjacent one of the posts to confine an insertion slot therebetween for insertion of the grip portion of one of the hand tools thereinto such that the first clamped surface is biased to urge the second clamped surface to abut against the clamping surface of the adjacent one of the posts, each of the tongues further extending towards a respective one of the cavities and terminating at a friction end such that when the grip portion of one of the hand tools is inserted through the insertion slot, the first clamped surface will force a respective one of the tongues to bring the friction end to abut against the shoulder portion against the biasing action, thereby ensuring firm clamping of the grip portion of the hand tool between the clamping surface of the adjacent one of the posts and the respective one of the tongues.

Preferably, the tool packaging and displaying device further includes front and rear wall portions disposed proximate to front and rear edges of the outer surface of the bottom wall, spaced apart from each other in the longitudinal direction, and respectively having front and rear anchored surfaces that face outwardly. The front anchored surface further has a front retaining surface opposite to the front anchored surface in the first transverse direction. The front anchored surface has a retaining slot extending in the first transverse direction to communicate with the front retaining surface. The front retaining surface has left and right retaining edge segments and a front edge segment, which cooperatively confine the retaining slot. The tool packaging and displaying device further includes a cover member having front and rear end portions opposite to each other in the longitudinal direction. The rear end portion is hinged relative to the rear anchored surface so as to permit the cover member to turn about a hinge axis. The front end portion is configured to detachably engage the front anchored surface. The cover member includes a latch tongue disposed on the front end portion. The latch tongue includes a suspending section extending from the front end portion inwardly and in the first transverse direction and terminating at a turning end, and a tongue section extending from the turning end outwardly and in the first transverse direction. The tongue section is spaced apart from the suspending section in the longitudinal direction so as to generate a biasing action which urges the tongue section away from the suspending section. The tongue section has a front major surface distal to the suspending section, and a rear major surface opposite to the front major surface and proximate to the suspending section such that when the latch tongue is inserted into the retaining slot, the tongue section moves toward the suspending section against the biasing action. The latch tongue includes a hook unit disposed on the front major surface such that immediately after the hook unit is brought to extend beyond the front retaining surface in the course of insertion of the latch tongue into the retaining slot, the hook unit is biased to snap at the front retaining edge segment so as to be retained thereby. The cover member further includes a locking insert insertable between the suspending section and the tongue section such that the locking insert is forced to be interposed therebetween against the biasing action of the tongue section.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
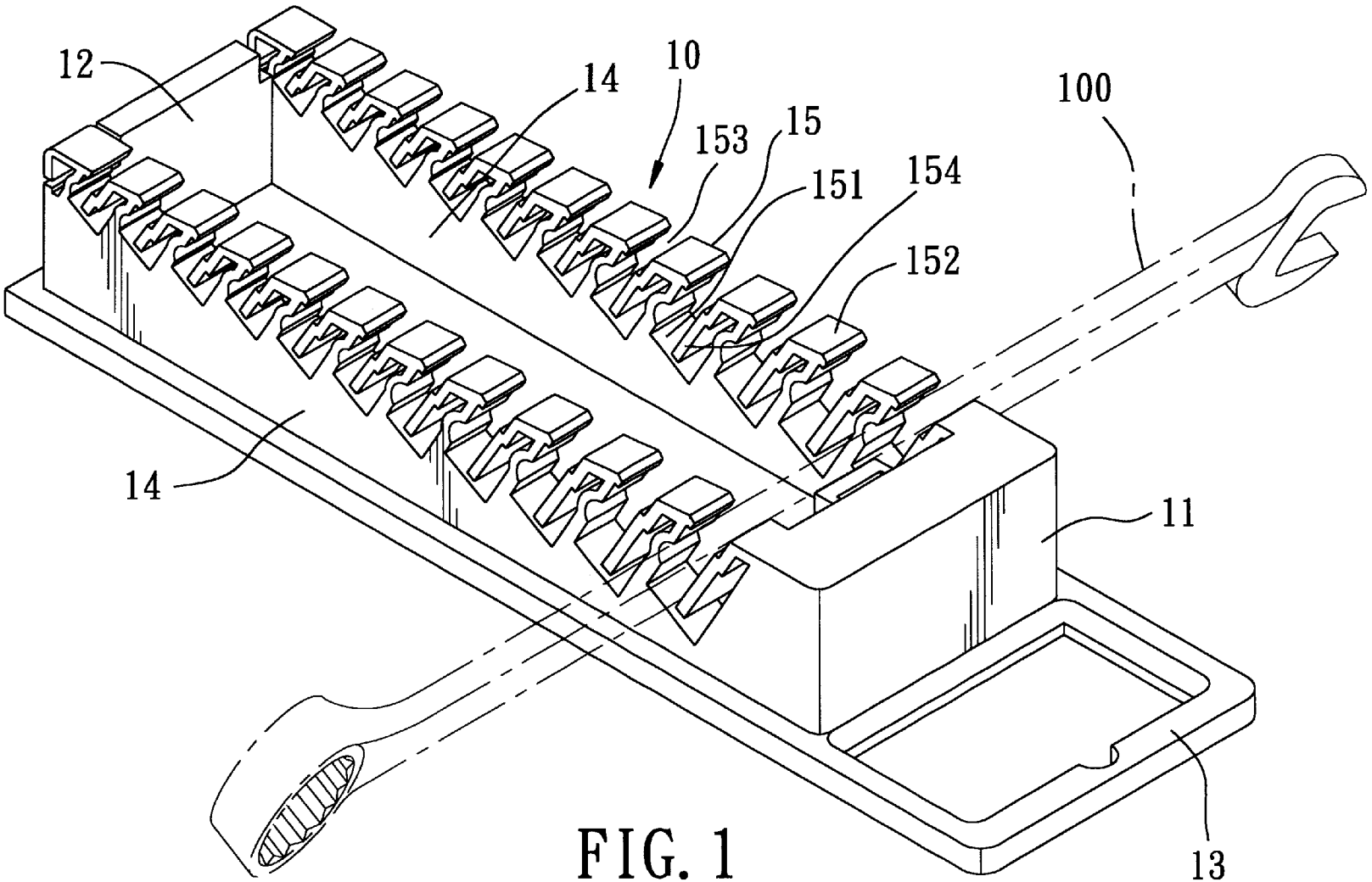
FIG. 1 PRIOR ART
FIG. 1 is a perspective view of a conventional tool packaging and displaying device adapted for holding a spanner.
Figure 2:
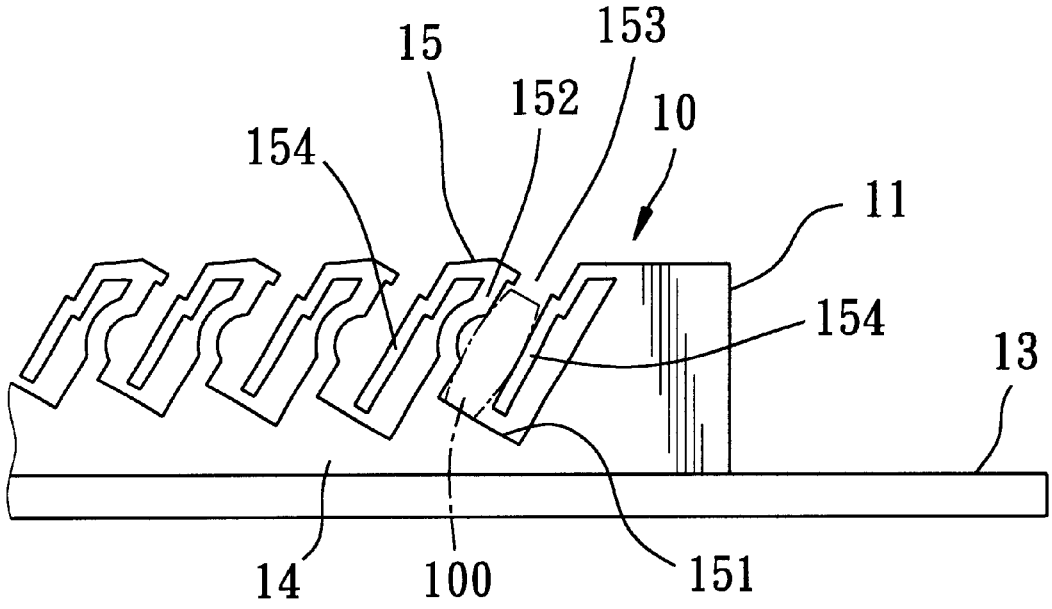
FIG. 2 PRIOR ART
FIG. 2 is a fragmentary schematic view of the device of FIG. 1, showing how a grip portion of the spanner is held between adjacent clamping units.
Figure 3:
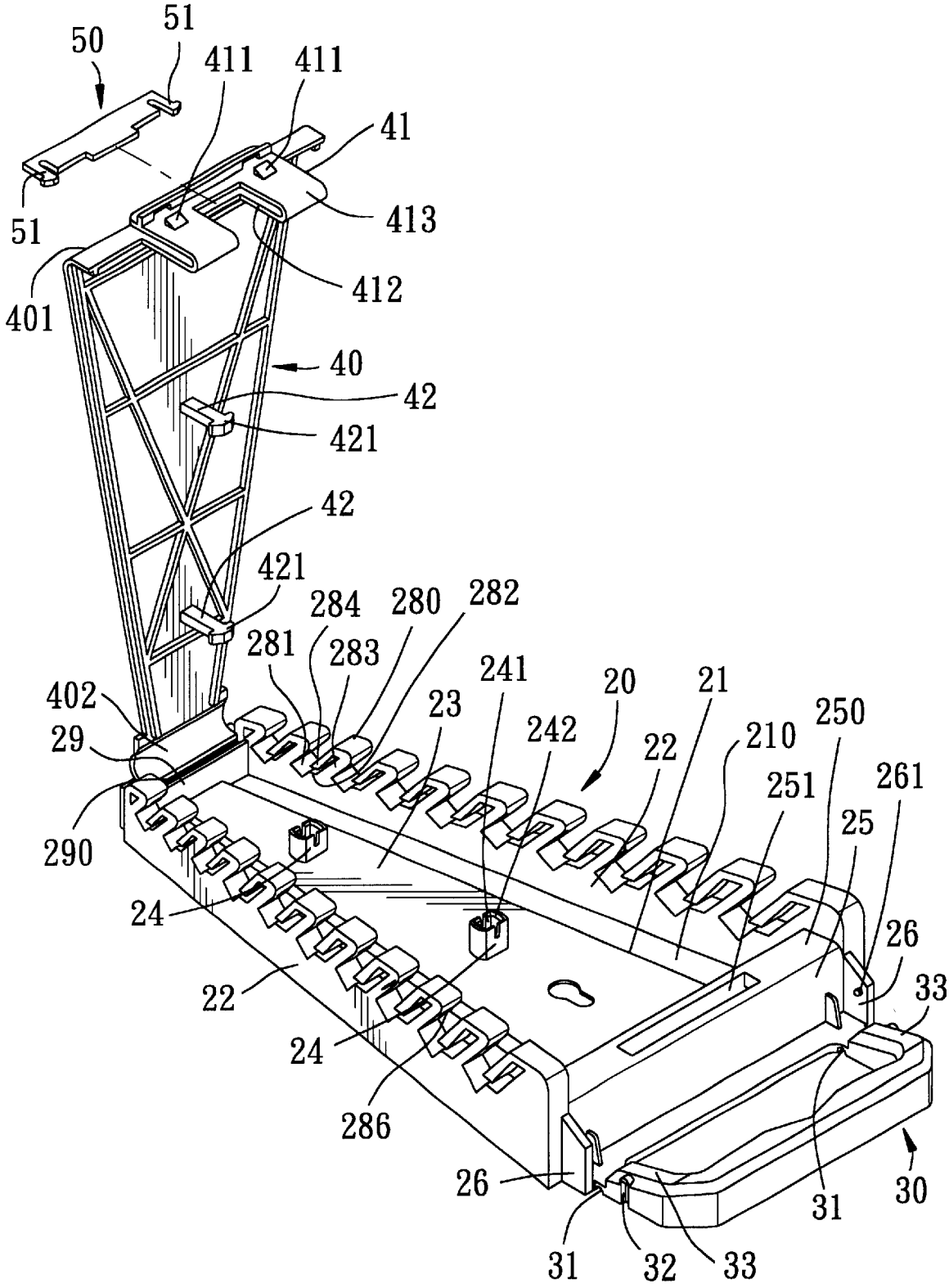
FIG. 3 is a partly exploded perspective view of the preferred embodiment of a tool packaging and displaying device according to the invention, in which a cover member is opened.
Figure 4:
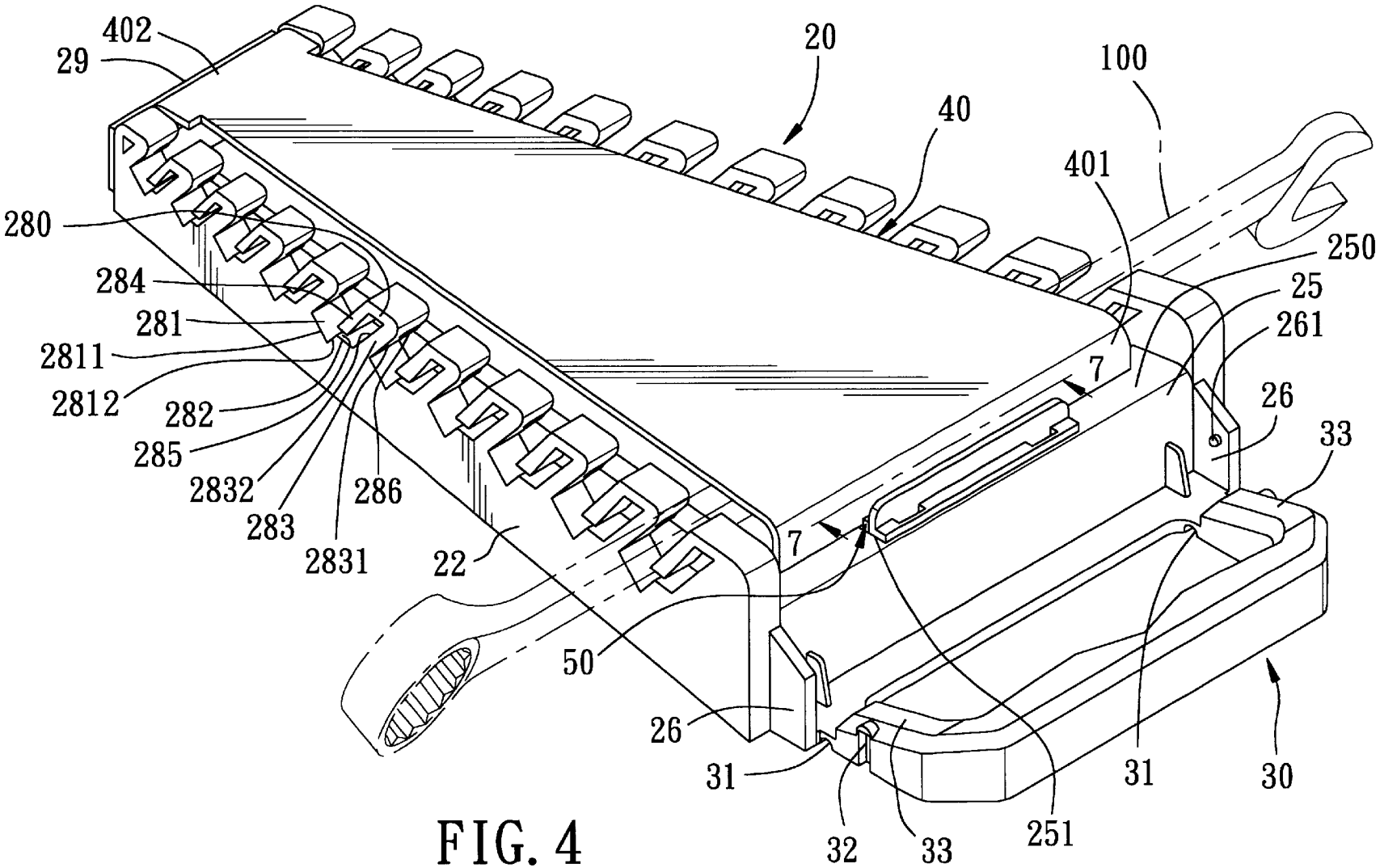
FIG. 4 is a perspective view of the preferred embodiment, illustrating how a spanner is held in place by the cover member.
Figure 5:
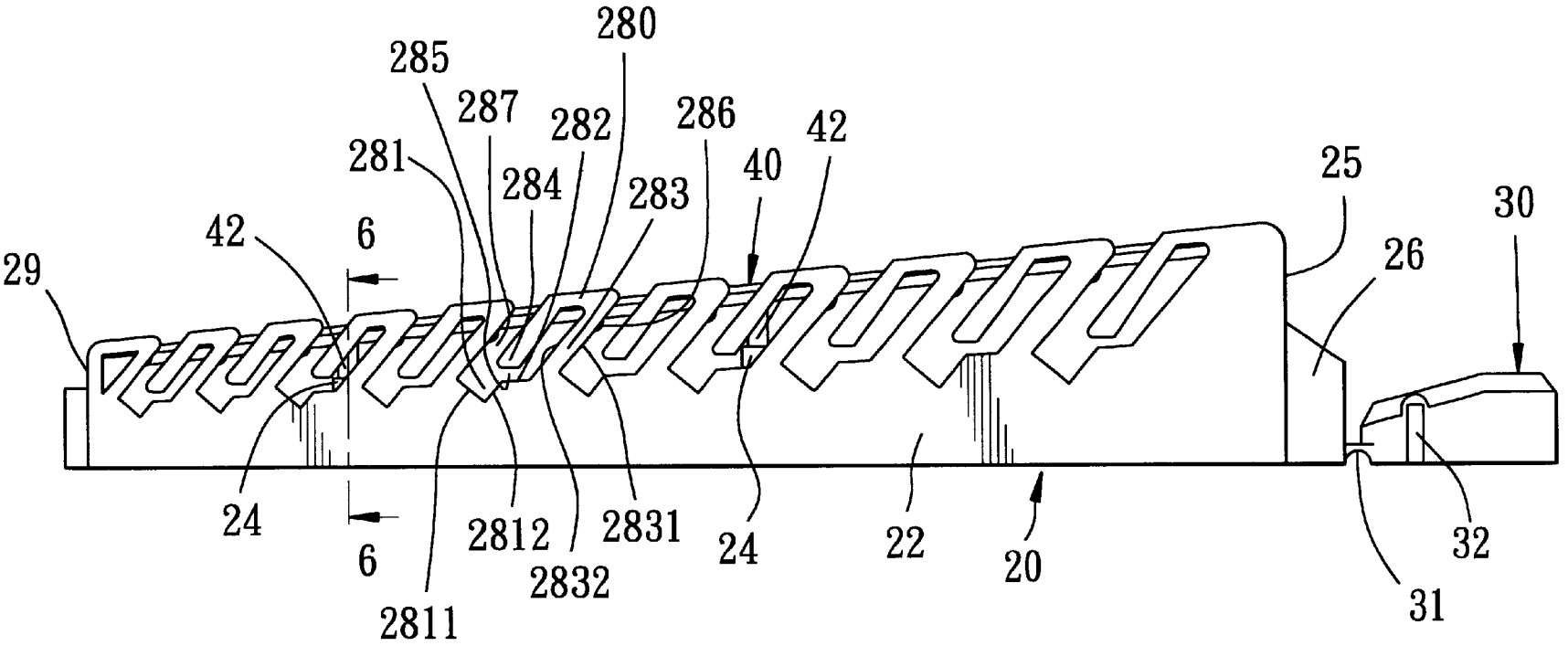
FIG. 5 is a side view of the preferred embodiment.

Referring to FIGS. 3 to 9, the preferred embodiment of a tool packaging and displaying device is adapted for holding a plurality of hand tools, such as spanners, thereon. As shown, the tool packaging and displaying device includes a generally trapezoidal mounting body 20 and a cover member 40.

The mounting body 20 includes a bottom wall 21, left and right mounting wall portions 22, and front and rear wall portions 25, 29, which cooperatively confine a receiving space 23. The bottom wall 21 has outer and inner surfaces 210, 211 (see FIG. 6) opposite to each other in a first transverse direction. The outer surface 210 has left and right edges extending in a longitudinal direction and opposite to each other in a second transverse direction transverse to both the first transverse direction and the longitudinal direction, and front and rear edges extending in the second transverse direction and opposite to each other in the longitudinal direction. The front and rear wall portions 25, 29 are disposed respectively proximate to the front and rear edges, are spaced apart from each other in the longitudinal direction, and have front and rear anchored surfaces 250, 290, respectively, that face outwardly.

The left and right mounting wall portions 22 extend integrally and respectively from the left and right edges in the first transverse direction and outwardly, and terminate respectively at left and right mounting surfaces which face outwardly and which are spaced apart from each other in the second transverse direction. Each of the left and right mounting surfaces 22 includes a plurality of cavities 281 displaced from one another in the longitudinal direction. Each of the cavities 281 extends inwardly and in the second direction to form a seat wall 2811, and a proximate wall 2812 which forms an angle with the seat wall 2811 and which cooperates with a respective one of the left and right mounting surfaces to form a substantially level shoulder portion 282 that borders on the respective one of the left and right mounting surfaces at a junction. The cavities 281 have predetermined widths and depths for receiving hand tools of different sizes. Each of the cavities 281 in the left mounting surface is aligned with a corresponding one of the cavities 281 in the right mounting surface in the second transverse direction so as to cooperatively hold a grip portion of a hand tool lengthwise. In the embodiment as illustrated, a spanner 100 which has an elongated grip portion extending in a lengthwise direction, first and second clamped surfaces 101, 102 opposite to each other, and a seated wall surface 103 that joins the first and second clamped surfaces 101, 102 (see FIG. 8), is held in two corresponding ones of the cavities 281.

Left and right sets of posts 283 project integrally from the left and right mounting surfaces, respectively. Each of the posts 283 extends from the respective junction outwardly and in the first transverse direction to terminate at an outer end, and has a clamping surface 2831 and a non-abutting surface 2832 which is disposed opposite to the clamping surface 2831 in the longitudinal direction and proximate to the respective shoulder portion 282.

Left and right sets of cantilevers 280 extend respectively and integrally from the outer ends of the posts 283 of the left and right sets in the longitudinal direction. Each of the cantilevers 280 extends away from the clamping surface 2831 of a respective one of the posts 283 to terminate at an end edge.

Left and right sets of tongues 284 are disposed to extend inwardly and integrally from the end edges of the cantilevers 280 of the left and right sets of cantilevers 280. Each of the tongues 284 is spaced apart from the respective one of the posts 283 in the longitudinal direction so as to be able to generate a biasing action. Each of the tongues 284 confronts and cooperates with the clamping surface 2831 of an adjacent one of the posts 283 to confine an insertion slot 287 therebetween for insertion of the grip portion of the respective spanner 100 thereinto such that the first clamped surface 101 is biased to urge the second clamped surface 102 to abut against the clamping surface 2831 of the adjacent one of the posts 283. Each of the tongues 284 further extends towards the respective one of the cavities 281 and terminates at a friction end which is proximate to the shoulder portion 282 and which is spaced apart therefrom by a clearance 285 under normal conditions. When the grip portion of the spanner 100 is inserted through the respective insertion slot 287 into the respective one of the cavities 281 such that the seated wall surface 103 abuts against the seat wall 2811, the first clamped surface 101 will force the respective one of the tongues 284 to bring the respective friction end to abut against the respective shoulder portion 282 against the biasing action, thereby ensuring firm clamping of the grip portion of the spanner 100 between the clamping surface 2831 of the adjacent one of the posts 283 and the respective one of the tongues 284. In addition, a projection 286 is provided on the clamping surface 2831 to prevent slippage of the spanner 100 after the grip portion of the spanner 100 is inserted into the respective one of the cavities 281.

Figure 7:
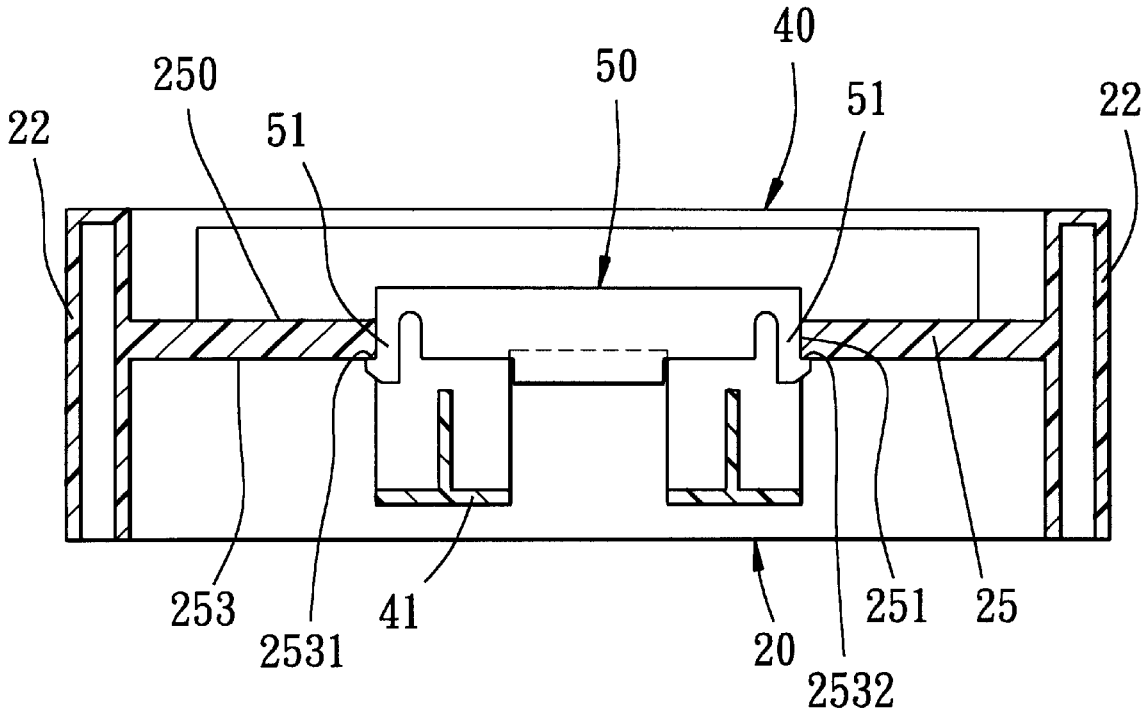
FIG. 7 is a schematic sectional view taken along line 7—7 of FIG. 4, illustrating how a latch tongue of the cover member is retained by a locking insert.
Figure 8:
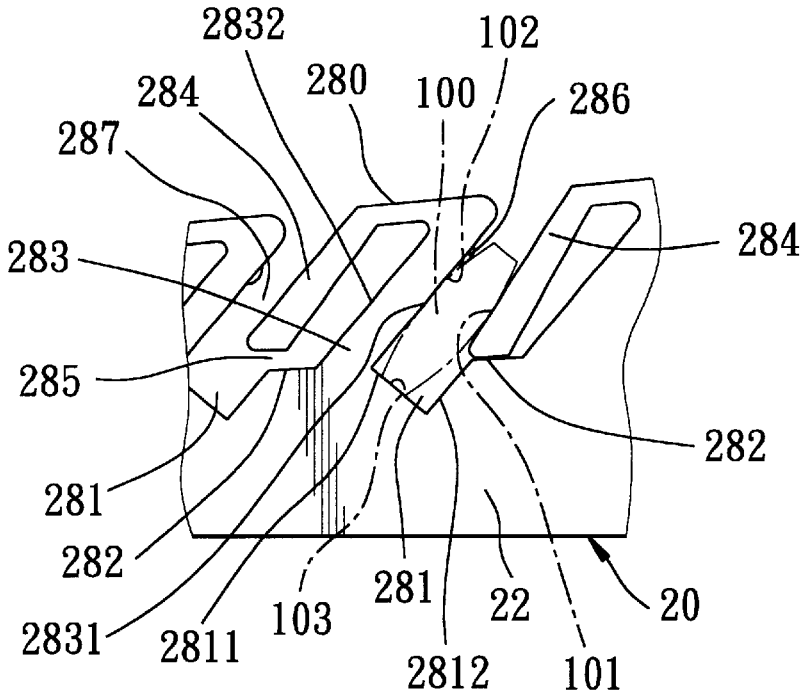
FIG. 8 is a fragmentary schematic view of the preferred embodiment, illustrating how a grip portion of the spanner is firmly held in a cavity between the clamping surface of a post and a tongue that has a friction end abutting against a shoulder portion.

Referring to FIG. 7, the front wall portion 25 further has a front retaining surface 253 opposite to the front anchored surface 250 in the first transverse direction. The front anchored surface 250 has a rectangular retaining slot 251 extending in the first transverse direction to communicate with the front retaining surface 253. The front retaining surface 253 has left and right retaining edge segments 2531, 2532 that are spaced apart from each other in the second transverse direction, and a front retaining edge segment 2533 (see FIG. 9) extending in the second transverse direction and joining the left and right retaining edge segments 2531, 2532. The left, right and front retaining edge segments 2531, 2532, 2533 cooperatively confine the retaining slot 251.

Figure 9:
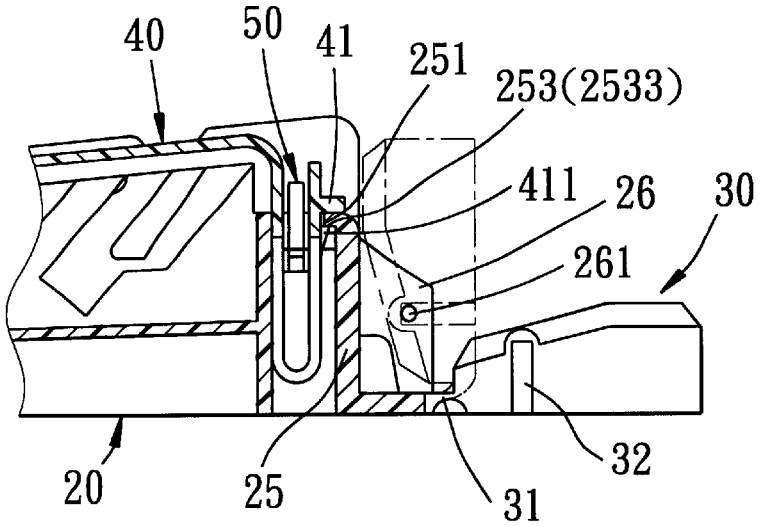
FIG. 9 is a fragmentary schematic sectional view of the preferred embodiment, illustrating how a handle member is foldable toward a front wall portion of a mounting body.

The cover member 40 is generally trapezoidal and is disposed to close the receiving space 23 to position the spanner 100 on the mounting body 20. The cover member 40 has front and rear end portions 401, 402 opposite to each other in the longitudinal direction. The rear end portion 402 is hinged relative to the rear anchored surface 290 so as to permit the cover member 40 to turn about a hinge axis. The front end portion 401 is configured to detachably engage the front anchored surface 250. The cover member 40 includes a latch tongue 41 disposed on the front end portion 401. The latch tongue 41 includes a suspending section 412 extending from the front end portion 401 inwardly and in the first transverse direction and terminating at a turning end, and a tongue section 413 extending from the turning end outwardly and in the first transverse direction. The tongue section 413 is spaced apart from the suspending section 412 in the longitudinal direction so as to generate a biasing action that urges the tongue section 413 away from the suspending section 412. The tongue section 413 has a front major surface distal to the suspending section 412, and a rear major surface opposite to the front major surface and proximate to the suspending section 412 such that when the latch tongue 41 is inserted into the retaining slot 251, the tongue section 413 moves toward the suspending section 412 against the biasing action. The latch tongue 41 further includes a hook unit 411 in the form of a wedge-shaped projection and disposed on the front major surface of the tongue section 413 such that immediately after the hook unit 411 is brought to extend beyond the front retaining surface 253 during insertion of the latch tongue 41 into the retaining slot 251, the hook unit 411 is biased to snap at the front retaining edge segment 2533 so as to be retained thereby, as best seen in FIG. 9. In this embodiment, the latch tongue 41 has a U-shaped configuration with two suspending sections 412 and two tongue sections 413. The cover member 40 further includes a locking insert 50 insertable between the suspending section 412 and the tongue section 413 such that the locking insert 50 is forced to be interposed therebetween against the biasing action of the tongue section 413. The locking insert 50 has left and right hook ends 51 disposed to be opposite to each other in the second transverse direction and configured to be urged by biasing actions thereof to move leftward and rightward, respectively, and in the second transverse direction. As such, immediately after the left and right hook ends 51 are brought to extend beyond the front retaining surface 253, the left and right hook ends 51 are biased to snap at the left and right retaining edge segments 2531, 2532 so as to be retained thereby, respectively, as shown in FIG. 7. Thus, the tongue section 413 can be prevented from being pressed toward the suspending section 412, thereby discouraging attempts to release the latch tongue 41 from the retaining slot 251.

Figure 6:
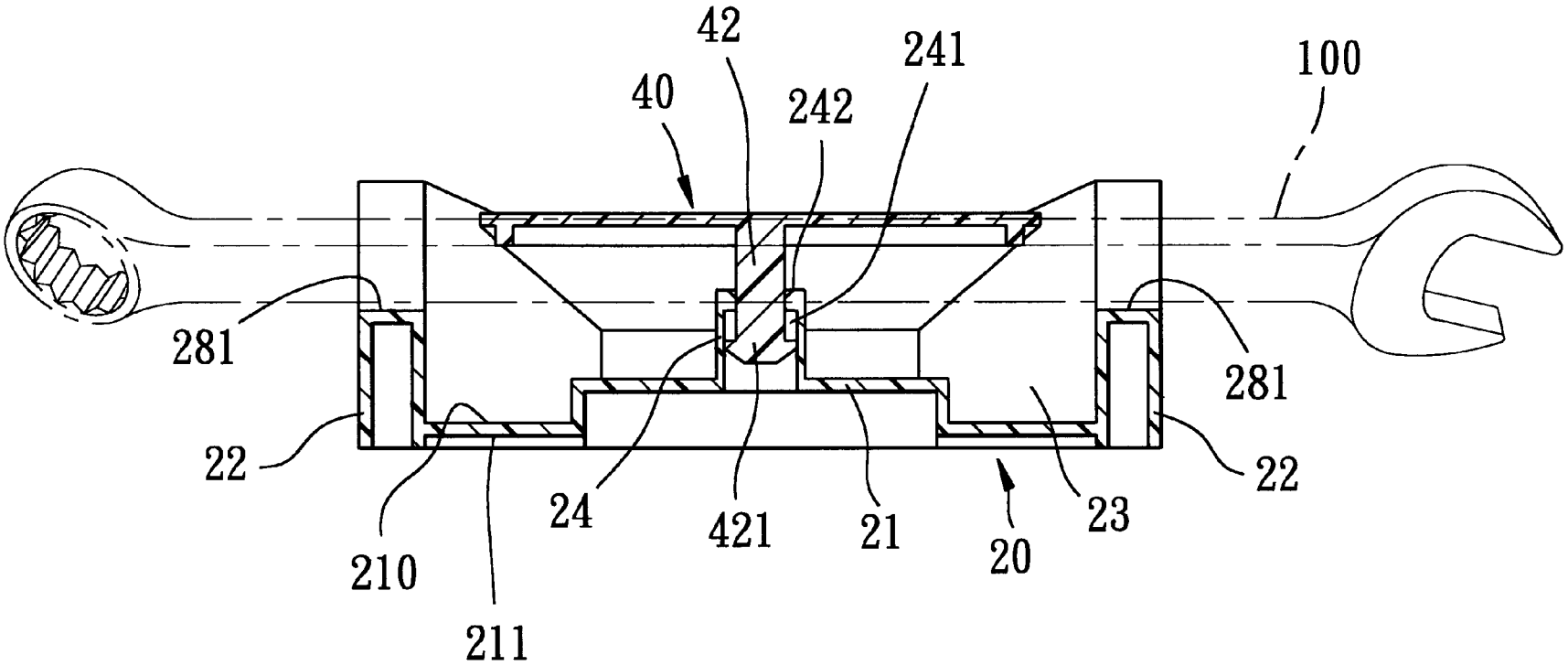
FIG. 6 is a schematic sectional view taken along line 6—6 of FIG. 5, illustrating how a hook stem is retained in a hook securing post on a bottom wall.

With further reference to FIG. 6, the outer surface 210 of the bottom wall 21 has a hook securing post 24 disposed thereon. The hook securing post 24 confines a hook hole 241 and has an enlarged opening portion 242. The hook hole 241 extends through the inner surface 211 to form an inner peripheral area on the inner surface 211 to confine the hook hole 241. The cover member 40 further includes a hook stem 42 which extends toward the bottom wall 21. The hook stem 42 is configured such that when the front end portion 401 engages the front anchored surface 251, the hook stem 42 is retained in the hook hole 241. The hook stem 42 includes an enlarged head 421 such that when the hook stem 42 is retained by press fitting in the hook hole 241, the enlarged head 421 is disposed beneath and abuts against the inner peripheral area. In this embodiment, there are provided two hook stems 42 and two hook securing posts 24.

The invention further includes a handle member 30 having two ends opposite to each other in the second transverse direction, and spaced apart from the front wall portion 25 in the longitudinal direction. Left and right bars 33 extend respectively from the ends of the handle member 30 in the longitudinal direction to connect integrally to the front wall portion 25 of the mounting body 20 at left and right junctions 31, respectively. The left and right junctions 31 are configured to have a smaller thickness so as to be foldable along a folding line in the second transverse direction to enable the handle member 30 to be turned about 90 degrees to a folded position where the handle member 30 is close to the front wall portion 25 (see FIG. 9) to facilitate delivery and storage in a compact size. The handle member 30 is secured in the folded position by means of a securing member which, in this embodiment, includes two retaining notches 32 respectively formed in the left and right bars 33 for retaining bosses 261 which project respectively from two lugs 26 that extend from the left and right mounting walls 22 in the longitudinal direction proximate to the front wall portion 25. The tool packaging and displaying device can be carried or hung on a wall by virtue of the handle member 30.

When the spanner 100 is displayed on the preferred embodiment, as the hook stem 42 is pressed fitted in the hook hole 241 and as the latch tongue 41 is prevented from being released from the retaining slot 251 by the locking insert 50, the cover member 40 cannot be opened unless the hook stem 42 is destroyed and the locking insert 50 is removed via the inner surface 211 of the bottom wall 21, there by providing greater security against theft. Besides, after the hook stem 42 and the locking insert 50 are removed, the mounting body 20 can be used as a tool kit that can be properly closed and opened without any problem.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A tool packaging and displaying device for holding a plurality of hand tools, each of the hand tools having an elongated grip portion extending in a lengthwise direction, first and second clamped surfaces opposite to each other, and a seated wall surface that joins the first and second clamped surfaces, said tool packaging and displaying device comprising:

a bottom wall having outer and inner surfaces opposite to each other in a first transverse direction, said outer surface having left and right edges extending in a longitudinal direction and opposite to each other in a second transverse direction transverse to both the first transverse direction and the longitudinal direction;

left and right mounting wall portions extending respectively from said left and right edges in the first transverse direction and outwardly, and terminating respectively at left and right mounting surfaces which face outwardly, which are spaced apart from each other in the second transverse direction, and which cooperate with said bottom wall to confine a receiving space thereamong, each of said left and right mounting surfaces including a plurality of cavities displaced from one another in the longitudinal direction, each of said cavities extending inwardly and in the second direction to form a seat wall adapted to receive the seated wall surface of a respective one of the hand tools, and a proximate wall which forms an angle with said seat wall and which cooperates with a respective one of said left and right mounting surfaces to form a shoulder portion that borders on the respective one of said left and right mounting surfaces at a junction;

left and right sets of posts, each of said posts extending from said junction outwardly and in the first transverse direction to terminate at an outer end, and having a clamping surface and a non-abutting surface which is disposed opposite to said clamping surface in the longitudinal direction and proximate to said shoulder portion;

left and right sets of cantilevers, each of said cantilevers extending from said outer end of a respective one of said posts in the longitudinal direction and away from said clamping surface of the respective one of said posts to terminate at an end edge;

left and right sets of tongues, each of said tongues being disposed to extend inwardly from said end edge of a respective one of said cantilevers and being spaced apart from said non-abutting surface of a respective one of said posts in the longitudinal direction so as to be able to generate a biasing action, each of said tongues confronting and cooperating with said clamping surface of an adjacent one of said posts to confine an insertion slot therebetween for insertion of the grip portion of one of the hand tools thereinto such that the first clamped surface is biased to urge the second clamped surface to abut against said clamping surface of the adjacent one of said posts, each of said tongues further extending towards a respective one of said cavities and terminating at a friction end such that when the grip portion of said one of the hand tools is inserted through said insertion slot, the first clamped surface will force a respective one of said tongues to bring said friction end to abut against said shoulder portion against the biasing action, thereby ensuring firm clamping of the grip portion of said one of the hand tools between said clamping surface of the adjacent one of said posts and the respective one of said tongues.

2. A tool packaging and displaying device according to claim 1, wherein each of said cavities in said left mounting surface is aligned with a corresponding one of said cavities in said right mounting surface in the second transverse direction so as to be adapted to cooperatively hold the grip portion of the respective one of the hand tools.

3. A tool packaging and displaying device according to claim 1, wherein said outer surface of said bottom wall has front and rear edges extending in the second transverse direction and opposite to each other in the longitudinal direction, said tool packaging and displaying device further including front and rear wall portions which are disposed respectively proximate to said front and rear edges, which are spaced apart from each other in the longitudinal direction, and which respectively have front and rear anchored surfaces that face outwardly, said front and rear wall portions cooperating with said left and right mounting wall portions to further confine said receiving space; and a cover member having front and rear end portions opposite to each other in the longitudinal direction, said rear end portion being hinged relative to said rear anchored surface so as to permit said cover member to turn about a hinge axis, said front end portion being configured to detachably engage said front anchored surface.

4. A tool packaging and displaying device according to claim 3, wherein said front wall portion further has a front retaining surface opposite to said front anchored surface in the first transverse direction, said front anchored surface having a retaining slot extending in the first transverse direction to communicate with said front retaining surface, said front retaining surface having left and right retaining edge segments that are spaced apart from each other in the second transverse direction, and a front retaining edge segment extending in the second transverse direction to join said left and right retaining edge segments, said left, right and front retaining edge segments cooperatively confining said retaining slot;

said cover member further including a latch tongue disposed on said front end portion, said latch tongue including a suspending section extending from said front end portion inwardly and in the first transverse direction and terminating at a turning end, and a tongue section extending from said turning end outwardly and in the first transverse direction, said tongue section being spaced apart from said suspending section in the longitudinal direction so as to generate a biasing action which urges said tongue section away from said suspending section, said tongue section having a front major surface distal to said suspending section, and a rear major surface opposite to said front major surface and proximate to said suspending section such that when said latch tongue is inserted into said retaining slot, said tongue section moves toward said suspending section against the biasing action.

5. A tool packaging and displaying device according to claim 4, wherein said latch tongue includes a hook unit disposed on said front major surface such that immediately after said hook unit is brought to extend beyond said front retaining surface in the course of insertion of said latch tongue into said retaining slot, said hook unit is biased to snap at said front retaining edge segment so as to be retained thereby.

6. A tool packaging and displaying device according to claim 5, wherein said cover member includes a locking insert insertable between said suspending section and said tongue section such that said locking insert is forced to be interposed therebetween against the biasing action of said tongue section.

7. A tool packaging and displaying device according to claim 6, wherein said locking insert has left and right hook ends disposed to be opposite to each other in the second transverse direction and configured to be urged by biasing actions to move leftward and rightward, respectively, and in the second transverse direction such that immediately after said left and right hook ends are brought to extend beyond said front retaining surface, said left and right hook ends are biased to snap at said left and right retaining edge segments, respectively, so as to be retained thereby, thus preventing said tongue section from being pressed toward said suspending section to discourage an attempt to release said latch tongue from said retaining slot.

8. A tool packaging and displaying device according to claim 3, wherein said outer surface of said bottom wall has a hook hole extending through said inner surface to form an inner peripheral area on said inner surface to confine said hook hole, said cover member including a hook stem extending toward said bottom wall and being configured such that when said front end portion engages said front anchored surface, said hook stem is retained in said hook hole.

9. A tool packaging and displaying device according to claim 8, wherein said hook stem includes an enlarged head such that when said hook stem is retained by press fitting in said hook hole, said enlarged head is disposed beneath and abuts against said inner peripheral area.

10. A tool packaging and displaying device according to claim 3, further comprising a handle member having two ends opposite to each other in the second transverse direction, and spaced apart from said front wall portion in the longitudinal direction, and left and right bars extending respectively from said ends of said handle member in the longitudinal direction to connect to said front wall portion at left and right junctions, respectively.

11. A tool packaging and displaying device according to claim 10, wherein said left and right junctions are configured to be foldable along a folding line in the second transverse direction so as to enable said handle member to be brought to a folded position where said handle member is close to said front wall portion.

12. A tool packaging and displaying device according to claim 11, further comprising a securing member disposed to secure said handle member in the folded position.

13. A tool packaging and displaying device for holding a plurality of hand tools, each of the hand tools having an elongated grip portion extending in a lengthwise direction, said tool packaging and displaying device comprising:

a mounting body including:

a bottom wall having outer and inner surfaces opposite to each other in a first transverse direction, said outer surface having left and right edges extending in a longitudinal direction and disposed to be opposite to each other in a second transverse direction transverse to the first transverse direction and the longitudinal direction, and front and rear edges extending in the second transverse direction and opposite to each other in the longitudinal direction, left and right mounting walls extending respectively from said left and right edges in the second transverse direction and outwardly, each of said left and right mounting walls including a plurality of mounting units, said mounting units of said left mounting wall being aligned with said mounting units of said right mounting wall, respectively, for holding the grip portions of the hand tools, and front and rear wall portions disposed proximate to said front and rear edges, respectively, and spaced apart from each other in the longitudinal direction, said front and rear wall portions, said bottom wall and said left and right mounting walls cooperatively defining a receiving space, said front and rear wall portions respectively having front and rear anchored surfaces which face outwardly, said front wall portion further having a front retaining surface opposite to said front anchored surface in the first transverse direction, said front anchored surface having a retaining slot extending in the first transverse direction to communicate with said front retaining surface, said front retaining surface having left and right retaining edge segments that are spaced apart from each other in the second transverse direction, and a front retaining edge segment extending in the second transverse direction and joining said left and right retaining edge segments, said left, right and front retaining edge segments cooperatively confining said retaining slot; and a cover member having front and rear end portions opposite to each other in the longitudinal direction, said rear end portion being hinged relative to said rear anchored surface so as to permit said cover member to turn about a hinge axis, said front end portion being configured to detachably engage said front anchored surface, said cover member including a latch tongue disposed on said front end portion, said latch tongue including a suspending section extending from said front end portion inwardly and in the first transverse direction and terminating at a turning end, and a tongue section extending from said turning end outwardly and in the first transverse direction, said tongue section being spaced apart from said suspending section in the longitudinal direction so as to generate a biasing action which urges said tongue section away from said suspending section, said tongue section having a front major surface distal to said suspending section, and a rear major surface opposite to said front major surface and proximate to said suspending section such that when said latch tongue is inserted into,said retaining slot, said tongue section moves toward said suspending section against the biasing action, said latch tongue including a hook unit disposed on said front major surface such that immediately after said hook unit is brought to extend beyond said front retaining surface in the course of insertion of said latch tongue into said retaining slot, said hook unit is biased to snap at said front retaining edge segment so as to be retained thereby, said cover member further including a locking insert insertable between said suspending section and said tongue section such that said locking insert is forced to be interposed therebetween against the biasing action of said tongue section.

* * * * *